US005430623A

United States Patent [19]

Uchida

[11] Patent Number: 5,430,623

[45] Date of Patent: Jul. 4, 1995

[54] HEADLAMP FOR VEHICLES

[75] Inventor: Naoki Uchida, Shimizu, Japan

[73] Assignee: Koito Manufacturing Co., Ltd., Tokyo, Japan

[21] Appl. No.: 230,201

[22] Filed: Apr. 20, 1994

[30] Foreign Application Priority Data

Apr. 20, 1993 [JP] Japan ..... 5-115175

[51] Int. Cl.[6] ..... F21M 3/16

[52] U.S. Cl. ..... 362/61; 362/298; 362/301

[58] Field of Search ..... 362/61, 298, 299, 301, 362/346, 351

[56] References Cited

U.S. PATENT DOCUMENTS

| | | | |
|---|---|---|---|
| 4,636,923 | 1/1987 | Oyama et al. | 362/298 |
| 4,914,747 | 4/1990 | Nino | 362/61 |
| 4,922,398 | 5/1990 | Muto | 362/346 |
| 5,055,981 | 10/1991 | Nino | 362/61 |
| 5,067,054 | 11/1991 | Oshio et al. | 362/346 |
| 5,111,368 | 5/1992 | Suzuki et al. | 362/61 |
| 5,130,900 | 7/1992 | Makita | 362/61 |
| 5,195,815 | 3/1993 | Watanabe et al. | 362/351 |
| 5,307,247 | 4/1994 | Cejnek | 362/298 |

*Primary Examiner*—Richard R. Cole
*Attorney, Agent, or Firm*—Sughrue, Mion, Zinn, Macpeak & Seas

[57] ABSTRACT

Disclosed is a vehicular headlamp, which has a reflecting surface curved outward, a lens covering the front of the reflecting surface and a filament disposed at a predetermined position at the reflecting surface, whereby the light emitted from the filament is reflected at the reflecting surface to irradiate a low beam. This headlamp further has an auxiliary reflecting surface provided at a position out of the region which extends from the filament and covers the effective reflecting surface of the reflecting surface. The auxiliary reflecting surface is positioned substantially horizontal and substantially parallel to the irradiation direction. The vehicular headlamp with the above structure can therefore produce beams to illuminate overhead signs from the light reflected at the auxiliary reflecting surface while emitting no dazzling light to an approaching vehicle from the auxiliary reflecting surface. Further, this headlamp does not deteriorate the designability of the lens.

13 Claims, 6 Drawing Sheets

HEADLAMP FOR VEHICLES

BACKGROUND OF THE INVENTION

1. Field of the Invention

The present invention relates to a novel headlamp for vehicles, and, more particularly, to a novel vehicular headlamp which can emit a beam that illuminates so-called overhead signs, which are placed over an expressway or the like.

2. Description of the Related Art

Drivers have no particular problems recognizing overhead signs, which are written by luminous paint or the like, at night, but may overlook non-luminous overhead signs at night unless sufficient light is around.

To cope with the above situation, some beams from the headlamp may be used to illuminate overhead signs.

FIG. 1 shows the luminous intensity distribution a of a low beam, which should illuminate a region b of about 2 to 5 degrees above the horizontal line.

To fulfill the requirement, a prism d which refracts light upward may be formed at the inner wall of a lens c at a position above the center thereof, as shown in FIG. 2. Parts e' of light beams e which travel nearly parallel to or slightly downward to the optical axis x—x are refracted upward by this prism d to illuminate overhead signs.

The structure using the prism d formed on the inner wall of the lens c to provide beams to illuminate overhead signs raises several problems.

First, the portion of the lens c where the prism d is formed becomes too thick, causing the deterioration of the designability of such lenses.

There is another problem concerning the dazzling light to approaching vehicles from opposite direction. If light is irradiated to the region g between the aforementioned region b and the cut line f of the low beam a, it will dazzle the driver of an approaching vehicle so that no beams should be irradiated in this region g. According to the structure shown in FIG. 2, however, the prism rising portion h at the upper end portion of the prism d refracts the incident beams e to yield upward beams i which may dazzle the driver of an approaching vehicle.

SUMMARY OF THE INVENTION

It is therefore an object of the present invention to provide a headlamp for a vehicle, which can emit a beam that illuminates overhead signs, placed over an expressway or the like.

To achieve the above object, according to this invention, there is provided a headlamp for a vehicle, having a reflecting surface curved outward, a lens coveting the from of the reflecting surface and a light source disposed at a predetermined position at the reflecting surface, for reflecting light emitted from the fight source at the reflecting surface to irradiate a low beam, which headlamp further comprises an auxiliary reflecting surface provided at a position out of a region extending from the light source and covering an effective reflecting surface of the reflecting surface, substantially horizontal and substantially parallel to an irradiation direction.

The vehicular headlamp embodying the present invention with the above structure can produce beams to illuminate overhead signs from the light reflected at the auxiliary reflecting surface while emitting no dazzling light to an approaching vehicle from the auxiliary reflecting surface. Further, this headlamp does not deteriorate the designability of the lens.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Vehicular headlamps according to preferred embodiments of the present invention will now be described referring to the accompanying drawings.

Figure 1:
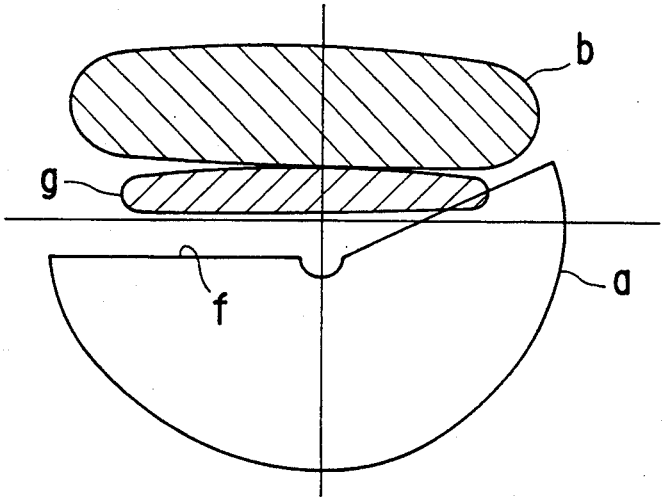
FIG. 1 PRIOR ART
FIG. 1 is a diagram showing the luminous intensity distribution of a low beam and the region for illuminating an overhead sign.
Figure 2:
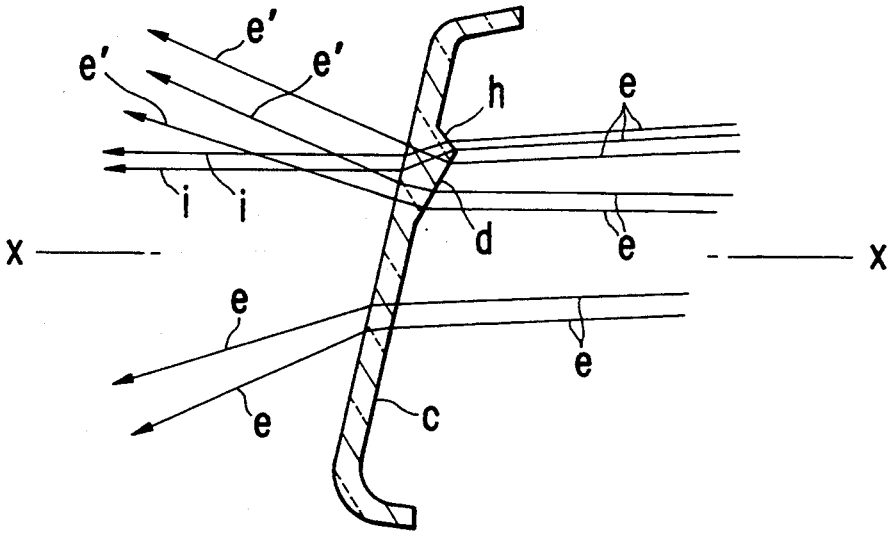
FIG. 2 PRIOR ART
FIG. 2 is a cross section showing essential portions of one example of conventional vehicular headlamps.
Figure 3:
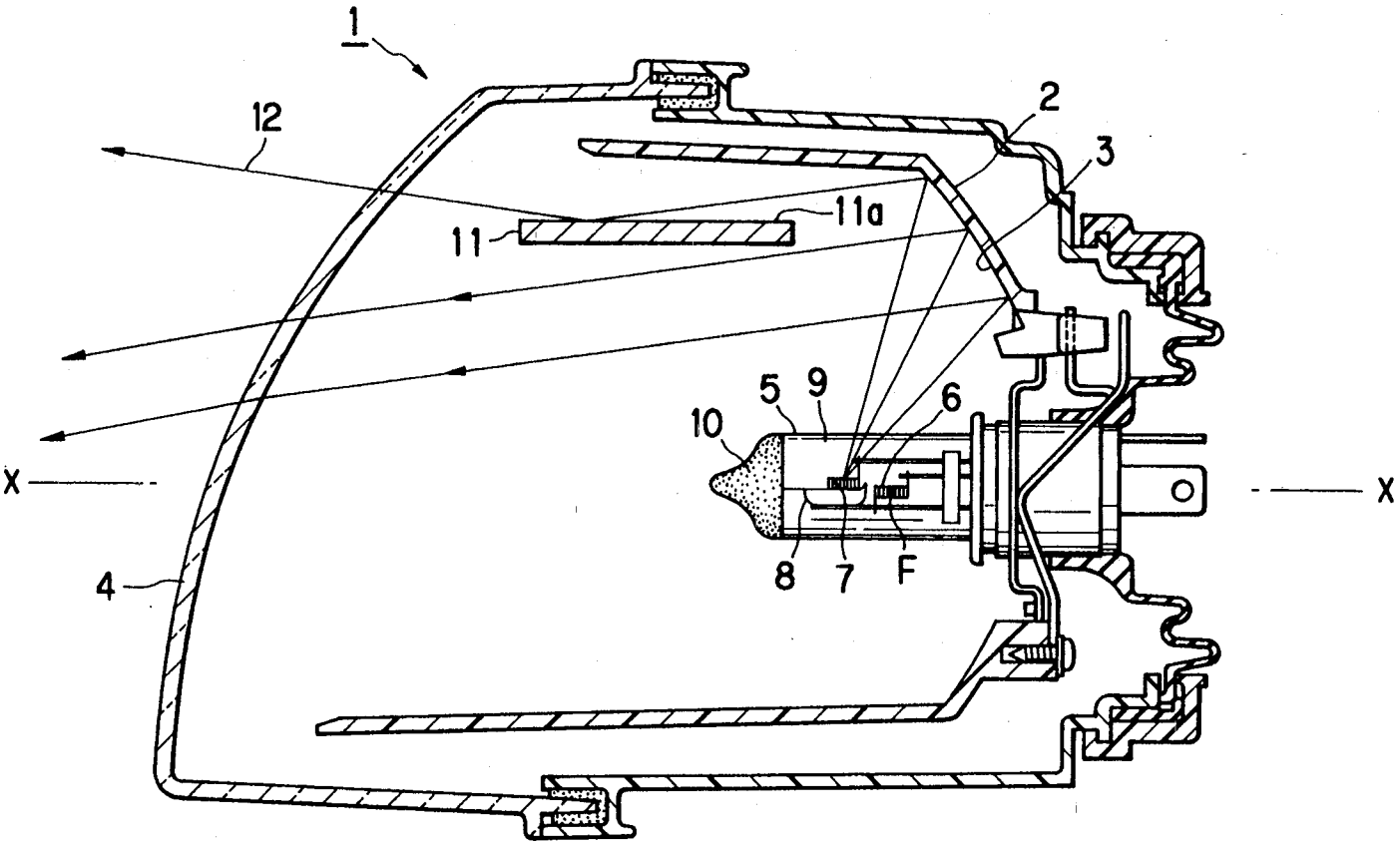
FIG. 3 is a vertical cross section showing a vehicular headlamp according to a first embodiment of the present invention.
Figure 4:
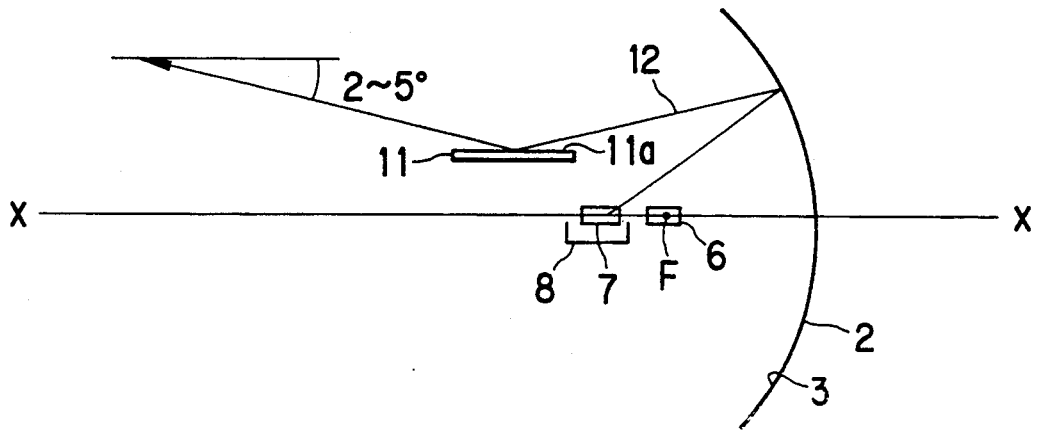
FIG. 4 is a schematic cross-sectional view for explaining the angle of an auxiliary reflecting surface.
Figure 5:
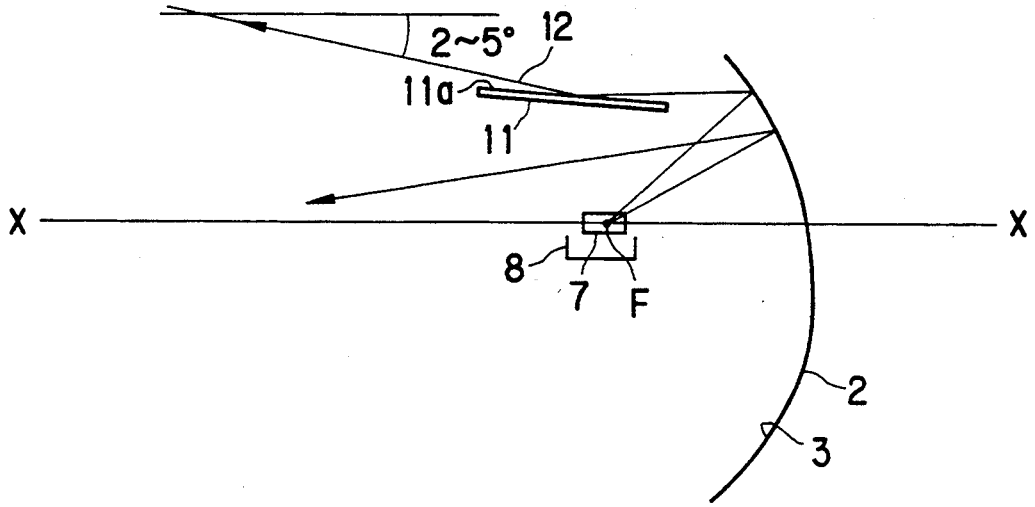
FIG. 5 is another schematic cross-sectional view for explaining the angle of an auxiliary reflecting surface.

FIGS. 3 through 5 illustrate vehicular headlamp according to a first embodiment of the present invention.

The vehicular headlamp 1 of the first embodiment is designed to use a high beam as well as a low beam to illuminate overhead signs;

A reflector 2 has an inner wall curved outward, with a reflection film formed on a portion 3 of the inner wall to become a reflecting surface. The portion 3 has the shape of a paraboloid of revolution. A lens 4 is disposed to cover the front opening of the reflector 2.

An electric bulb 5, mounted on the reflector 2, is of an H4 type, for example, and has a main filament 6 for irradiating a high beam and a sub-filament 7 for irradiating a low beam. The sub-filament 7 is located in front of the main filament 6. A light-shielding cap 8, which is located under the sub-filament 7, covers substantially the lower half of the sub-filament 7. A light-shielding coat 10 is formed on the front end portion of a glass tube 9.

The electric bulb 5 is mounted on the reflector 2 in such a way that the main filament 6 is located at approximately the focusing position of the reflecting surface 3.

Beams emitted toward the reflecting surface 3 from the main filament 6 are reflected frontward, nearly parallel to one another, at that surface 3. Because of the light-shielding cap 8 and the light-shielding coat 10, beams emitted from the sub-filament 7 are prevented from traveling forward but travel toward only the nearly upper half of the reflecting surface 3. The beams directed to the upper half of the reflecting surface 3 are reflected slightly downward at that surface 3 due to the sub-filament 7 located in front of the focusing point of the surface 3.

A flat auxiliary reflector 11 has an upper surface 11 a serving as a reflecting surface. The auxiliary reflector 11 is located out of the region above the electric bulb 5 and extending from the sub-filament 7 to the opposite portion of the reflecting surface 3, and is positioned approximately horizontal. That is, the auxiliary reflector 11 is positioned approximately horizontal within the region where the reflector 11 does not interfere with the beams emitted toward the reflecting surface 3 from the sub-filament 7.

Therefore, the beams traveling toward the upper half portion of the reflecting surface 3 from the sub-filament 7 are reflected slightly downward at the reflecting surface 3. Some of the beams, 12, are reflected by the reflecting surface 11*a* of the auxiliary reflector 11 or the auxiliary reflecting surface 11*a* and travel slightly upward to thereby contribute in illuminating an overhead sign.

The beams 12 should be emitted upward at an angle of 2 to 5 degrees. The angle of the auxiliary reflecting surface 11*a*, which extends nearly horizontal, should be adjusted in accordance with the angle at which the beams 12 are reflected at the reflecting surface 3. For example, if the sub-filament 7 is located in front of the focusing point of the reflecting surface 3 as shown in FIG. 4, the beams 12 are reflected slightly downward at the reflecting surface 3 so that the auxiliary reflecting surface 11*a* can remain horizontal. If the sub-filament 7 is located at approximately the focusing point of the reflecting surface 3 as shown in FIG. 5, however, the beams 12 are reflected in the parallel direction at the reflecting surface 3. Therefore, the auxiliary reflecting surface 11a needs to be inclined slightly upward and frontward so that the beams 12 are directed upward at an angle of 2 to 5 degrees.

Figure 6:
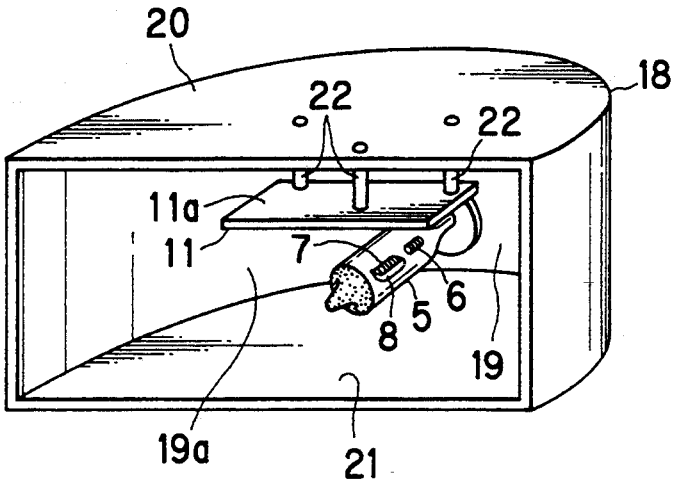
FIG. 6 is a vertical cross section showing a vehicular headlamp according to a second embodiment of the present invention.
Figure 7:
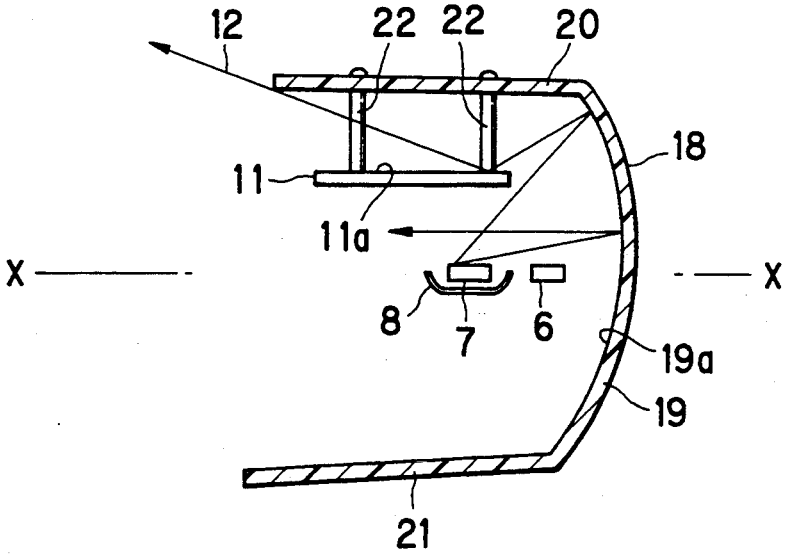
FIG. 7 is a perspective view illustrating how to provide the auxiliary reflecting surface according to the first embodiment.

FIGS. 6 and 7 illustrate a specific example of attaching the auxiliary reflector 11 of the vehicular headlamp 1 according to the first embodiment. A reflector 18 has an elongated effective reflecting surface potion 19 which has the shape of a paraboloid of revolution with the truncated top and bottom, and flat surface potions 20 and 21 covering the top and bottom of the effective reflecting surface potion 19. The effective reflecting surface portion 19 has an inner wall 19*a* serving as a reflecting surface. The electric bulb 5 is supported by this reflector 18.

The auxiliary reflector 11 is suspended from the upper fiat surface potion 20 by supports 22.

Figure 8:
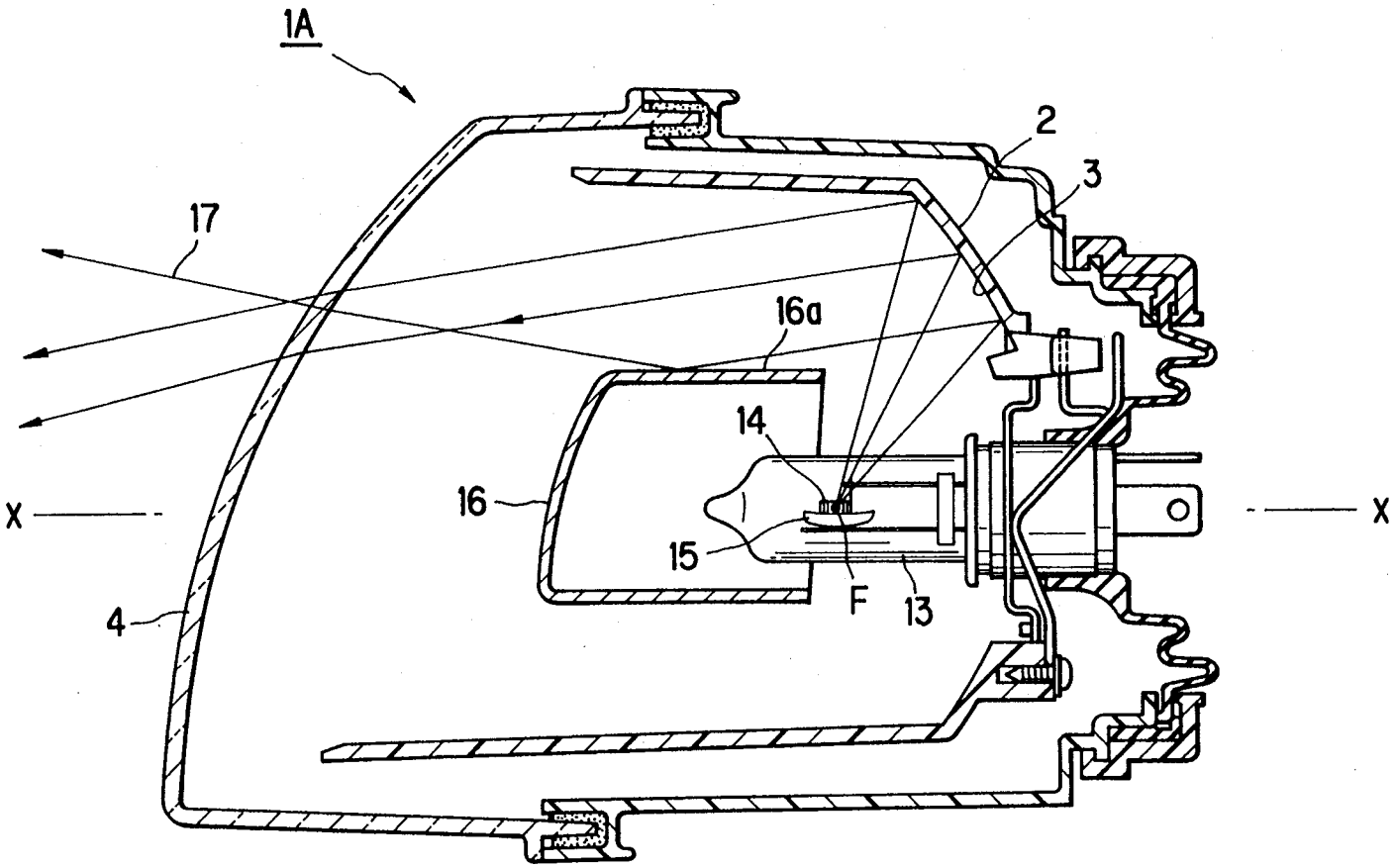
FIG. 8 is a cross section showing the auxiliary reflecting surface.

FIG. 8 illustrates a vehicular headlamp according to a second embodiment of the present invention.

In this vehicular headlamp 1A, an electric bulb 13, supported by the reflector 2, has a single filament 14 located slightly in front of the focusing point of the reflecting surface 3.

Nearly the lower half of the filament 14 is covered with a light-shielding cap 15 so that no light from the filament 14 will reach nearly the lower half of the reflecting surface 3.

A shade 16, which covers the front end potion of the electric bulb 13, prevents the light from the filament 14 from traveling directly forward. The shade 16 has a flat upper surface 16*a* serving as a reflecting surface. This reflecting surface 16*a* is positioned nearly horizontal.

Beams 17, parts of the beams from the filament 14 which are reflected at the upper half of the reflecting surface 3, are reflected upward at an angle of 2 to 5 degrees at the reflecting surface 16*a* of the shade 16 or the auxiliary reflecting surface 16*a*.

Figure 9:
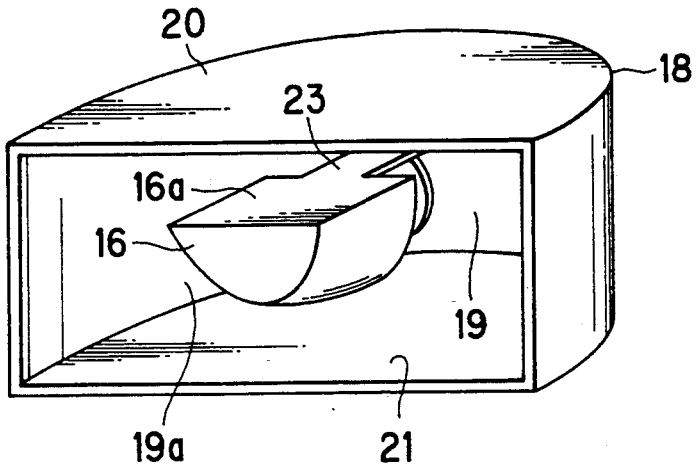
FIG. 9 is a perspective view illustrating how to provide the auxiliary reflecting surface according to the second embodiment.
Figure 10:
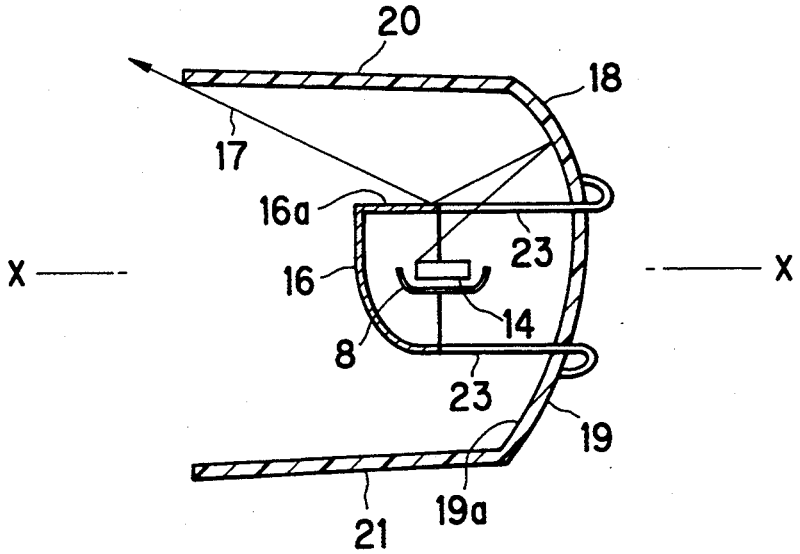
FIG. 10 is a cross section showing the auxiliary reflecting surface.

FIGS. 9 and 10 illustrate a specific example of attaching the shade 16 of the second embodiment. Legs 23 extending rearward from the top and bottom of the shade 16 are supported by the effective reflecting surface portion 19 of the reflector 18.

As apparent from the above description, the vehicular headlamp according to the present invention has a reflecting surface curved outward, a lens covering the front of the reflecting surface, a light source disposed at a predetermined position at the reflecting surface, for reflecting light emitted from the light source at the reflecting surface to irradiate a low beam, and an auxiliary reflecting surface provided at a position out of a region from the light source to an effective reflecting surface of the reflecting surface, substantially horizontal and substantially parallel to an irradiation direction.

The vehicular headlamp embodying the present invention with the above structure can therefore produce beams to illuminate overhead signs from the light reflected at the auxiliary reflecting surface while emitting no dazzling light to an approaching vehicle from the auxiliary reflecting surface. Further, this headlamp does not deteriorate the designability of the lens.

The specific shapes and structures of the individual components of the above-described embodiments are to be considered as illustrative and not restrictive and the invention is not to be limited to the details given herein, but may be modified within the scope of the appended claims.

What is claimed is:

1. A headlamp for a vehicle which is operative to project light from a low beam in an upward direction for illumination of overhead objects, said headlamp comprising a reflecting surface curved outward, a lens covering a front of said reflecting surface and a light source disposed at a predetermined position at said reflecting surface, for reflecting light emitted from said light source at said reflecting surface to irradiate said low beam, said headlamp further comprising:

an auxiliary reflecting surface provided at a position out of a region extending in an irradiation direction from said light source and covering an effective reflecting portion of said reflecting surface, substantially horizontal and substantially parallel to said irradiation direction, said auxiliary reflecting surface being operative to reflect light beams upwardly with respect to said irradiation direction beyond said lens.

2. The headlamp for a vehicle according to claim 1, wherein said reflecting surface is provided on an inner wall of a reflector, said reflecting surface having the shape of a paraboloid of revolution.

3. The headlamp for a vehicle according to claim 1, wherein said light source is an electric bulb comprising at least a front end portion.

4. The headlamp for a vehicle according to claim 3, wherein said electric bulb has a main filament for irradiating a high beam and a sub-filament for irradiating a low beam, said sub-filament being located in from of said main filament.

5. The headlamp for a vehicle according to claim 4, wherein said electric bulb is mounted on said reflector in such a way that said main filament is located at approximately a focusing point of said reflecting surface.

6. The headlamp for a vehicle according to claim 3, wherein a light-shielding coat is formed on the front end portion of said electric bulb.

7. The headlamp for a vehicle according to claim 3, wherein said electric bulb has a single filament located slightly in front of a focusing point of said reflecting surface.

8. The headlamp for a vehicle according to claim 7, wherein nearly a lower half of said filament is covered with a light-shielding cap.

9. The headlamp for a vehicle according to claim 3, wherein a front end portion of said electric bulb is covered with a shade having a flat upper surface as said auxiliary reflecting surface.

10. The headlamp for a vehicle according to claim 9, wherein said shade is provided such that said light beams are reflected upward at an angle of 2 to 5 degrees at said auxiliary reflecting surface of said shade.

11. The headlamp for a vehicle according to claim 1, wherein said auxiliary reflecting surface is flat and has an upper surface located above said light source.

12. The headlamp for a vehicle according to claim 1, wherein said auxiliary reflecting surface is provided such that said beams are emitted upward at an angle of 2 to 5 degrees.

13. The headlamp for a vehicle according to claim 1, wherein said auxiliary reflecting surface is at an incline according to the angle at which beams are reflected at said reflecting surface.

* * * * *